US007377284B2

(12) United States Patent
Faulhaber

(10) Patent No.: US 7,377,284 B2
(45) Date of Patent: May 27, 2008

(54) SPINNER BAR

(76) Inventor: James Faulhaber, 10033 Dahlia Ave., Palm Beach Gardens, FL (US) 33410-4706

( * ) Notice: Subject to any disclaimer, the term of this patent is extended or adjusted under 35 U.S.C. 154(b) by 314 days.

(21) Appl. No.: 10/803,591

(22) Filed: Mar. 17, 2004

(65) Prior Publication Data

US 2005/0205120 A1 Sep. 22, 2005

(51) Int. Cl.
*B08B 3/02* (2006.01)

(52) U.S. Cl. ..... 134/176; 134/181; 134/198; 239/251

(58) Field of Classification Search ..... 134/198, 134/181; 239/251; 15/49.1
See application file for complete search history.

(56) References Cited

U.S. PATENT DOCUMENTS

| | | | | | |
|---|---|---|---|---|---|
| 3,118,607 | A | * | 1/1964 | Rocher | 239/104 |
| 3,748,050 | A | * | 7/1973 | Poppitz | 401/289 |
| 4,191,589 | A | * | 3/1980 | Halls et al. | 134/21 |
| 4,191,590 | A | * | 3/1980 | Sundheim | 134/21 |
| 4,377,018 | A | * | 3/1983 | Cain | 15/322 |
| 4,903,364 | A | * | 2/1990 | Long | 15/50.1 |
| 5,004,156 | A | * | 4/1991 | Montanier | 239/130 |
| 5,265,805 | A | * | 11/1993 | Artenian | 239/135 |
| 5,456,412 | A | * | 10/1995 | Agee | 239/104 |
| 5,636,402 | A | * | 6/1997 | Kubo et al. | 15/98 |
| 5,970,574 | A | * | 10/1999 | Thrash, Jr. | 15/321 |
| 6,012,645 | A | * | 1/2000 | Poppitz | 239/104 |
| 6,129,094 | A | * | 10/2000 | Moll et al. | 134/21 |
| 6,151,748 | A | * | 11/2000 | Earhart et al. | 15/321 |
| 6,230,984 | B1 | * | 5/2001 | Jager | 239/225.1 |
| 6,392,967 | B1 | * | 5/2002 | Nakayama et al. | 369/44.34 |

FOREIGN PATENT DOCUMENTS

| | | | |
|---|---|---|---|
| DE | 20115506 | * | 1/2002 |
| GB | 2 024 611 | * | 1/1980 |
| JP | 8-84964 | * | 4/1996 |

OTHER PUBLICATIONS

WIPO WO 85/02211 May 1985.*
Europenan Patent Office 0 597 787 May 1994.*

* cited by examiner

*Primary Examiner*—Frankie L. Stinson
(74) *Attorney, Agent, or Firm*—McHale & Slavin, P.A.

(57) ABSTRACT

An improved spinner bar for rotary surface cleaning machines includes an array of spray nozzles at each end of the bar. The nozzles in each array are adjustable. The outermost nozzle in each array is oriented at a different angle of inclination to the plane of rotation than the angle of the inner nozzles. The improved spinner bar results in a more uniform appearance in the cleaned surface, has a low noise level and reduces man-hours.

2 Claims, 2 Drawing Sheets

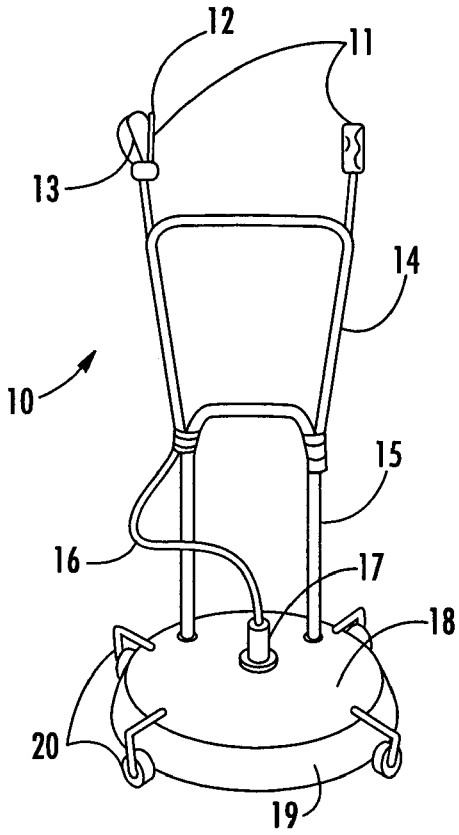
FIG. 1
(PRIOR ART)
FIG. 2
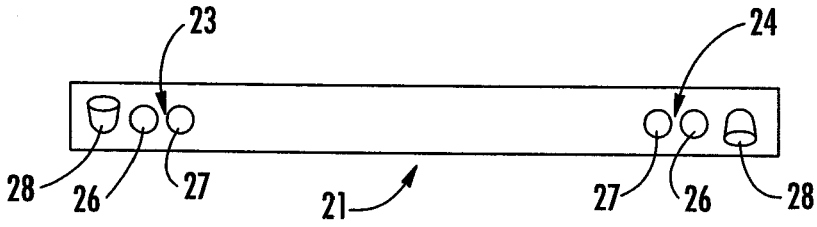

SPINNER BAR

FIELD OF THE INVENTION

This invention relates to the field of rotary pressure cleaning machines.

BACKGROUND OF THE INVENTION

"Cleaner Times," published by Advantage Publishing Co. Inc., Little Rock, Ak. is a monthly publication of the technical journal of the high pressure water applications industry. Rotary pressure cleaning machines are well known within this large industry.

The machines usually have handlebars to control a spray head. The spray head has a hood or shroud that encloses a rotary spray bar or spinner bar which carries spray nozzles. The spray head may be mounted on wheels or it may float on the residual pressure from the spray nozzles. Pressurized liquid is supplied through the spray head and spinner bar to the nozzles, via a standard engine and pump configuration, to produce a spray that accomplishes the work of cleaning a surface over which the machine is maneuvered. The spinner bar may be rotated by the reaction force of the spray nozzles or it may be independently powered, as by the combination of a belt and motor, or both.

U.S. Pat. No. 4,191,590 to Sundheim is typical of such machines and discloses a spinner bar with two nozzles, one at each end of the bar. The nozzles may be adjusted as to the angle of inclination in regard to the plane of rotation, the spray pattern, flow rate, and spray arc. U.S. Pat. Nos. 6,370,728; 5,135,015; and 6,012,645 are each directed to a rotary machine having a spinner bar and one nozzle on each end. U.S. Pat. No. 5,265,805 is directed to a rotary machine with a three bladed spinner bar with one nozzle at each of the three ends.

There are certain shortcomings in the rotary pressure cleaning art which result in a non-uniform appearance of a cleaned surface and cause the machines to create excessive noise. The prior art machines are also generally restricted to hard surfaces due to the high pressure impact of the liquid upon a small area. The construction of the prior art devices deliver cleaning spray to a small impact area causing uneven application of the cleaning spray resulting in stripes and swirls on the cleaned surface. The small impact area also causes the prior art machines to have a high noise level and is also inefficient and usually requires retracing for adequate cleaning of a surface.

In the normal use of all rotary cleaners, the spray head is moved over a surface in a pattern of passes. Because of the rotation of the spray bar, each pass leaves a cleaned path the length of the pass and the width of the diameter of the spray bar. To clean a large area, a number of passes must be made with the edge of a later path overlapping the edge of an earlier path. This overlapping causes the same area of the surface to be cleaned more than once.

Conventional machines have a common problem of overlapping paths producing a series of stripes and swirls of extra-clean surface which contrasts with the remainder of the surface. To overcome this nonuniformity of color, the surface must be retraced until the stripes are obliterated or reduced. Regardless of the pattern of passes, straight, rectangular, or circular, the stripes or swirls created require more time and repetition to produce an acceptable uniform cleaned surface. This repetition results in increased labor costs and wear on the machines.

Because of the high pressures, for example 200-5000 psi, there is a significant level of noise during the use of the machine. Also, having a nozzle on each end of a two bladed or three bladed spray bar produces a small cleaned area equal to the narrow spray coverage as the spray bar rotates resulting in a particular time frame for cleaning a large surface. This high pressure limits the surfaces that the conventional machines can be used to clean without damaging the substrate, for example some nozzles will scour grout from between tiles, score soft woods for decks, or remove particles from roofing shingles.

What is needed in the art is a surface cleaner that has a lower noise level, accomplishes work faster, produces a uniform cleaned surface and can be used on softer surfaces.

SUMMARY OF THE PRESENT INVENTION

An improved spinner bar for rotary surface cleaning machines includes an array of spray nozzles at each end of the bar. The nozzles in each array are adjustable. The outermost nozzle in each array is oriented at a different angle of inclination to the plane of rotation than the angle of the inner nozzles. The improved spinner bar results in a more uniform appearance in the cleaned surface, has a low noise level and reduces man-hours.

Therefore, it is an objective of this invention to provide an improved spinner bar for a rotary washer that has an array of multiple nozzles at the ends of the spinner bar to reduce noise and increase the area impacted by the pressurized liquid.

It is another objective of this invention to provide the array of nozzles with an angle of inclination to the plane of rotation with the outermost nozzle having a different angle than inner nozzles to prevent stripes and swirls on the cleaned surface.

It is a further objective of this invention to provide an array of nozzles on the spinner bar that have a low impingment to prevent damage to soft surfaces during cleaning.

SHORT DESCRIPTION OF THE DRAWINGS

FIG. 1 is a perspective of a prior art rotary cleaning machine;

FIG. 2 is a plan view of the bottom of the spinner bar of this invention;

DETAILED DESCRIPTION OF THE INVENTION

Figure 3:
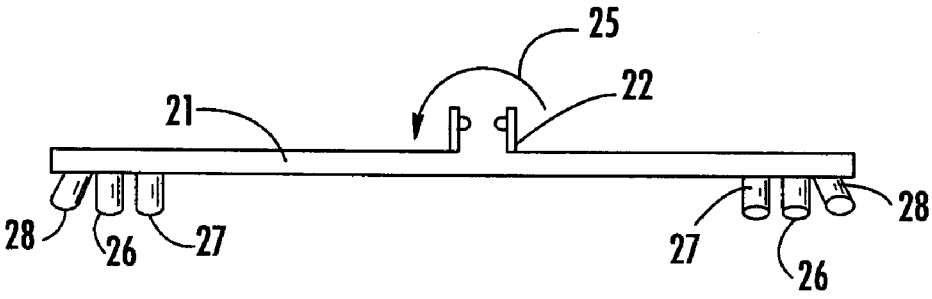
FIG. 3 is a side view of the spinner bar of this invention.

The prior art rotary cleaning machine 10, shown in FIG. 1, has handle bars 11. One handle bar includes trigger valve 13 and a high pressure connection 12 to supply high pressure fluid to the spinner bar through a high pressure hose 16 extending from the handle bar to the deck 18 of the shroud. The handle bars are connected to an upper frame 15. The upper frame 14 is hinged to a lower frame 15 which is connected to the deck 18. The deck 18 supports the high pressure connector 17 which connects the high pressure hose 16 and the rotary spinner bar 21, shown in FIG. 2. Caster wheels 20 are mounted on the deck to support the machine for rolling movement across a surface or substrate. The deck 18 preferably has a skirt 19 to contain the overspray from the nozzles and loosened debris from the cleaned surface.

Figure 4:
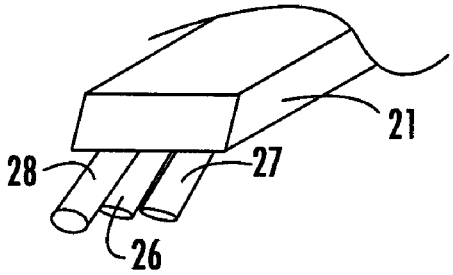
FIG. 4 is an end view of the spinner bar and nozzle array of this invention.

The spinner bar 21, shown in FIGS. 2, 3, and 4, has a rotary coupling 22 mounted on the center of the top of the bar. Each end of the bottom of the bar has an array 23 and 24 of nozzles at each end of the bar. Each array has three nozzles mounted at an angle of inclination with respect to the plane of rotation 25 of the spinner bar to provide reaction force for rotation of the bar. As, shown in the drawings, the inner two nozzles 26, 27 have the same first angle of inclination with respect to the spinner bar. In the preferred embodiment, the outer nozzle 28 has a different and lesser angle of inclination than the inner two nozzles. The angle of inclination of the nozzles is also preferably adjustable for varying surfaces and conditions. The nozzles may be adjusted laterally for differing degrees of overlap between nozzles or the fan type nozzles may be rotated to provide angular overlap of the pressurized fluid.

The arrangement of the nozzles in each array is such that the spray from each overlaps the spray of the others. The spray pattern may be conical, fan, or spot. The lesser angle of the outer spray results in a feathering effect such that the overlapping paths of the machine does not result in the creation of a stripe of ultra-clean surface upon subsequent passes of the machine.

Further, the six nozzles of the arrays cover a large area on each path allowing fewer rotational passes of the spray bar per square foot of surface. The fluid pressure in the line is divided by the six nozzles so that the noise produced by the machine is low when compared to the prior art. In addition, the fluid impingement on the surface to be cleaned is low enabling the machine to be used on shingle roofs, paving brick and concrete surfaces, and tile and grout surfaces, wood surfaces and others.

A comparative test was performed using the same rotary cleaning machine with different spinner bars of the same length. The test surface was a concrete driveway divided into 6 equal test zones. Each machine was used to clean 3 identical zones. Two zones were 30 feet long; 2 zones were 20 feet long; and 2 zones were 10 feet long. Each machine traversed each respective test zone in 5 passes. The machine produced 2000 psi and delivered 7.9 gallons per minute (gpm) using a 13 hp motor and a 150 feet length supply hose.

The comparative test results are as follows:

| | Conventional spinner bar | Improved spinner bar |
|---|---|---|
| No. of nozzles: | 2 | 6 in two arrays of 3 |
| Nozzle size: | #4.5 | # 2 |
| Stationary spray pattern: | circular<br>1" wide × 18" dia. | circular<br>4" wide × 19" dia. |
| Fan Spray Angle: | 65 deg. | 65 deg; 40 deg; 40 deg |
| Angle of inclination: | 74 deg. | 74 deg. |
| Zone 1: 30' | 1 min. 39 sec. | :47 sec. |
| Zone 2: 20' | 1:07 | :35 sec. |
| Zone 3: 10' | :36 | :14 sec. |
| Visual: | streaks and swirls in cleaned surface | no streaks and fewer swirls |
| Noise: | | noticeably lower sound to the human ear |

With regard to the conventional nozzle size and angle of inclination which determine RPM of the spinner bar, the size and angle are considered optimal for the pressure used in the test.

A number of embodiments of the present invention have been described. Nevertheless, it will be understood that various modifications may be made without departing from the spirit and scope of the invention. Accordingly, it is to be understood that the invention is not to be limited by the specific illustrated embodiment but only by the scope of the appended claims.

I claim:

1. In a portable surface cleaning machine for moving over a surface to be cleaned and producing a pressurized cleaning spray directed onto the surface, said machine including an elongated spinner bar having a first end, a second end, and a rotary mount therebetween, said spinner bar constructed and arranged to rotate in a plane parallel to the surface to be cleaned, the improvement comprising:

said spinner bar defined by a single tubular member having sealed ends and a plurality of apertures extending through a side wall of said tubular member constructed and arranged for accepting spray nozzles;

a first array of spray nozzles at said first end of said spray bar and a second array of spray nozzles at said second end of said spray bar, said first array and said second array each having an outermost nozzle and an inner nozzle, said outermost nozzle fixedly inclined at a first compound angle with respect to said plane to direct said cleaning spray at said surface on a rearward side of a vertical axis extending through said spray bar to provide motive force to cause rotation of said spray bar, said nozzle also angled to spray outwardly to spray beyond the distal end of said spinner bar and said inner nozzle fixedly inclined at a second substantially vertical angle with respect to said plane to direct said cleaning spray at said surface along said vertical axis extending through said spray bar, said inner nozzle and said outermost nozzle being positioned along a longitudinal axis of said spray bar so that a portion of the spray pattern produced by said inner nozzle overlaps a portion of the spray pattern produced by said outermost nozzle during rotation of said spinner bar, whereby said outer nozzles direct spray beyond the distal ends of said spinner bar to increase the effective width of the cleaned path and, whereby said overlapping spray patterns cause the cleaned area to have a uniform appearance.

2. In a portable surface cleaning machine for moving over a surface to be cleaned and producing a pressurized cleaning spray directed onto the surface, said machine including an elongated spinner bar having a first end, a second end, and a rotary mount therebetween, said spinner bar constructed and arranged to rotate in a plane parallel to the surface to be cleaned, the improvement comprising:

said spinner bar defined by a single tubular member having sealed ends and a plurality of apertures extending through a side wall of said tubular member constructed and arranged for accepting spray nozzles;

a first array of spray nozzles at said first end and a second array of spray nozzles at said second end, said first array and said second array each having an outermost nozzle an intermediate nozzle and an innermost nozzle, said outermost nozzle inclined at a first compound angle with respect to said plane to direct said cleaning spray at said surface on a rearward side of a vertical axis extending through said spray bar to provide motive force to cause rotation of said spray bar, said nozzle also angled to spray outwardly to spray beyond the distal end of said spinner bar, said intermediate nozzle inclined at a second substantially perpendicular angle with respect to said plane to direct said cleaning spray at said surface, and said at least one innermost nozzle inclined at a third substantially perpendicular angle with respect to said plane to direct said cleaning spray at said surface, said innermost nozzle, said intermediate nozzle and said outermost nozzle being positioned along a longitudinal axis of said spray bar so that a portion of the spray pattern produced by said at least one intermediate nozzle overlaps a portion of the spray pattern produced by said outermost nozzle and a portion of said innermost nozzle overlaps a portion of the spray pattern produced by said intermediate nozzle during rotation of said spinner bar, whereby said outer nozzles direct spray beyond the distal ends of said spinner bar to increase the effective width of the cleaned path and, whereby said overlapping spray patterns cause the cleaned area to have a uniform appearance.

* * * * *